US006378262B1

(12) United States Patent
Mercadante

(10) Patent No.: US 6,378,262 B1
(45) Date of Patent: Apr. 30, 2002

(54) TELESCOPING LOUVERED WINDOW INSERT

(76) Inventor: Robert Mercadante, 13 Guilfoy St., Glen Cove, NY (US) 11542

( * ) Notice: Subject to any disclaimer, the term of this patent is extended or adjusted under 35 U.S.C. 154(b) by 0 days.

(21) Appl. No.: 09/660,475

(22) Filed: Sep. 12, 2000

(51) Int. Cl.[7] ..... E06B 7/08

(52) U.S. Cl. ..... 52/473; 52/202; 52/311.3; 49/64; 49/74.1; 49/80.1; 160/104; 160/174; 160/185; 160/187; 160/221; 160/223; 160/235; 160/236; 454/221; 454/224

(58) Field of Search ..... 52/473, 311.1, 52/311.4, 202, 302.1, 506.05; 49/64, 74.1, 87.1, 403, 80.1; 160/235, 104, 89, 236, 166.1, 167, 174, 185, 187, 221, 223; 454/221, 224

(56) References Cited

U.S. PATENT DOCUMENTS

| | | | | | |
|---|---|---|---|---|---|
| 3,968,738 | A | | 7/1976 | Matzke | |
| 3,991,533 | A | | 11/1976 | Nagase | |
| 4,064,670 | A | | 12/1977 | Lichtenwald | |
| 4,103,468 | A | | 8/1978 | Olsen | |
| 4,103,601 | A | * | 8/1978 | Dayus | 98/110 |
| 4,452,024 | A | | 6/1984 | Sterriker et al. | |
| 4,951,728 | A | | 8/1990 | Takano | |
| 5,072,561 | A | * | 12/1991 | Pitt | 52/473 |
| 5,191,735 | A | * | 3/1993 | Ross | 49/74 |
| 5,203,394 | A | | 4/1993 | Hailey | |
| 5,293,920 | A | * | 3/1994 | Vagedes | 160/89 |
| 5,353,565 | A | | 10/1994 | Tanikawa | |
| 5,457,921 | A | * | 10/1995 | Kostrzecha | 52/202 |
| 5,490,353 | A | * | 2/1996 | McLaughlin | 49/64 |
| 5,950,384 | A | | 9/1999 | Aarness | |
| 6,041,547 | A | * | 3/2000 | Marocco | 49/87.1 |
| 6,219,985 | B1 | * | 4/2001 | Hsu | 52/473 |

* cited by examiner

*Primary Examiner*—Carl D. Friedman
*Assistant Examiner*—Yvonne M. Horton
(74) *Attorney, Agent, or Firm*—Michael I. Kroll

(57) ABSTRACT

The present invention 10 discloses a louvered window insert comprising two louvered frame sections 39, 50 each having one vertical member 44, 60 with an upper and lower horizontal member 40, 42, 56, 58 extending from each end thereof and a plurality of louver blades 46, 52 extending horizontally therebetween. The distal ends of the horizontal members and louver blades of the first section have recesses 48, 54 to receive and slidably secure the horizontal members 56, 58 and louver blades 52 of the second section as they travel therethrough allowing a user to size the insert to a window 12 simply by placing the fully overlapped assembly inside an open window 12 and separating the two frame sections 39, 50 thereby reducing the overlap of the horizontal members and the louvers and effectively elongating the insert until the two vertical members 44, 60 are flush to their respective side jambs and then lowering the window 12 until it sits atop the present invention. An additional embodiment is provided wherein the louver blades 46, 52 are generally flat with blade 46 having curved edges for receiving blade 52. An additional embodiment disclosed a storm window frame adapter 70 along with a storm window track adapter 72. Also, a tensioning means 88 is provided for securing the upper and lower horizontal frame members to each other.

15 Claims, 18 Drawing Sheets

TELESCOPING LOUVERED WINDOW INSERT

BACKGROUND OF THE INVENTION

1. Field of the Invention

The present invention relates generally to louvered window assemblies and, more specifically, to a louvered window insert having a telescoping frame and louver blades which would allow an installer to easily adjust the width of the insert to that of a window sash by placing it inside an open window and sliding the opposing frame ends outward until the sides of the louver frame are flush against the side jambs of said window and then closing the window until it sits atop the assembly. The telescoping louvered window insert comprises a first frame section having an upper horizontal member and a lower horizontal member connected to one another at one end by a vertical member having a plurality of horizontal louver blades fixedly or pivotally attached thereto with the distal end of each louver blade having a recess or cavity that extends longitudinally therethrough and a second frame member having louver blades of a size sufficient to slide securely within the recesses or cavities of the corresponding louver blades of the first frame sections. The horizontal members of the first frame section have retaining cavities or recesses to receive the horizontal members of the second frame section thereby allowing the width of the entire assembly to collapse or expand as needed within limited parameters. The present invention will provide windows with elemental protection when ventilation is desired and can be easily removed and installed in various sized windows as needed. The present invention could also be fabricated of a translucent or transparent material so as to provide the passage of light through said telescoping louvered window insert.

2. Description of the Prior Art

There are other louvered assemblies designed for windows. Typical of these is U.S. Pat. No. 3,968,738 issued to William A. Matzke on Jul. 13, 1976.

Another patent was issued to Mitsuo Nagase on Nov. 19, 1976 as U.S. Pat. No. 3,991,533. Yet another U.S. Pat. No. 4,064,670 was issued to Roger A. Lichtenwald on Dec. 27, 1977 and still yet another was issued on Aug. 1, 1978 to Robert W. Olsen as U.S. Pat. No. 4,103,468.

Another patent was issued to James Sterriker et al. on Jun. 5, 1984 as U.S. Pat. No. 4,452,024. Yet another U.S. Pat. No. 4,951,728 was issued to Kouichi Takano on Aug. 28, 1990. Another was issued to Anderson Hailey on Apr. 20, 1993 as U.S. Pat. No. 5,203,394 and still yet another was issued on Oct. 11, 1994 to Shinji Tamikawa as U.S. Pat. No. 5,353,565. One other patent was issued to James C. Aarness as U.S. Pat. No. 5,950,384.

U.S. Pat. No. 3,968,738

Inventor: William A. Matzke

Issued: Jul. 13, 1976

An assembly of plastic louver strips secured by two vertical frames having cut out portions into which the louver strips extend. Louver strips which are flexible can be snapped into place after the frame is in place. Flexible strips can also be removed for cleaning. The vertical frames are slidably assembled into basic frame members and when in place form a space into which the ends of the louvers are positioned.

U.S. Pat. No. 3,991,533

Inventor: Mitsuo Nagase

Issued: Nov. 16, 1976

A combination louver and window sash assembly includes a plurality of louver boards extending horizontally and each having a cross-section of substantially inverted-Y shape. A pair of parallel, vertical sash frames having vertically extending slots faced in opposed relation to one another and including pairs of cutout recesses formed in the marginal edges of the slots. The louver boards have their horizontal ends thrusted resiliently through the slots and received snappingly in the cutout recesses.

U.S. Pat. No. : 4,064,670

Inventor: Roger A. Lichtenwald

Issued: Jul. 13, 1976

A substantially rainproof louver for mounting in an outside wall of an enclosure. The louver has a perimeter frame and plurality of blades extending across the frame, the blades being upwardly inclined from the outer edges to their inner edges. Each of the blades has a gutter element extending along its outer, lower edge. The gutter element is defined by the lowermost portion of the blade, a vertical flange and a downwardly and inwardly inclined anti-splash lip at the upper edge of the vertical flange, the anti-splash lip overlying, at least in part, the lowermost portion of the blade and extending toward the blade.

U.S. Pat. No. 4,103,468

Inventor: Robert W. Olsen

Issued: Jul. 13, 1976

A drainable blade louver comprises a pair of spaced-apart vertical members supporting a multiplicity of elongated, horizontally extending, inclined blades, each of which is of uniform cross section along its length. Each blade has an upwardly open front drainage trough located adjacent the front edge of the blade and at least one second upwardly open drainage trough located in at least about the front one-third of the blade closely adjacent the front trough. Each of the troughs is defined by spaced-apart front and back walls, the upper edges of which are preferably located in a plane substantially parallel to the airflow streams passing between the blades, and a bottom wall spaced a substantial distance below the upper edges of the front and back walls such that the splash from water drops impinging on the bottom walls of the troughs is largely confined to the zone bounded by the walls of the troughs thereby minimizing entrainment of water in the airflow streams.

U.S. Pat. No. 4,452,024

Inventor: James Sterriker et al.

Issued: Jun. 5, 1984

A louver in which some louver blades have water breaks for catching water that drops onto such louver blade from above. A top cap includes a lip portion which has an inwardly directed lower portion which directs water onto a louver located beneath the top cap.

U.S. Pat. No. 4,951,728

Inventor: Kouichi Takano

Issued: Aug. 28, 1990

A louver device comprises a main body formed of a flexible sheet-like material. A large number of slits are formed in the main body such that the portions between the adjacent slits constitute slats. The louver device also comprises holding/deforming means for shearing at least part of the main body in the direction of the surfaces of the main body. The shearing force applied to the main body serves to twist the end of the slats, thereby slanting the slats.

U.S. Pat. No. 5,203.394

Inventor: Anderson Hailey

Issued: Apr. 20, 1993

The triangular shape of the louvers allow light to pass through the first and second color-tinted adjacent sides to add a soft color hue to a room. The third side of the triangular louver is opaque and acts much the same as does a common blind when used to block the light from entering a room. The third side may, however have a decorative scene or pattern on one it to present a pleasant scene to the onlooker. The third side has a rotation restriction and alignment tab on it to align the third sides of the louvers so that the decorative pattern or scene is clearly illustrated and that the louver is positioned to properly block the light. Each louver is removably attached to a support system in such a manner that the louvers may be rotated to allow light to pass through two of the adjacent sides and then be rotated so that the opaque third side is parallel to the window or door and restricts the passage of the light.

U.S. Pat. No. 5,353,565

Inventor: William A. Shinji Tanikawa

Issued: Oct. 11, 1994

A louvered window assembly comprises a fixed window unit B fixedly fitted on a rear side within a window opening A, a louver unit C being slightly less in height and width than the window opening A and to be fitted on a front side within the window opening A, and means for releasably fitting the louver unit C within the window opening A. The louver-unit fitting means comprises a support bracket 31 fastened to the front side of the fixed window B, a hanger bracket 32 fastened to the rear side of the louver unit C and coming into engagement with the support bracket 31, a louver header 20 fastened to the front side of an upper inside surface A3 of the window opening A, a pair of louver jambs 22, 22 fastened one on the front side of each vertical inside surface A3, an upper horizontal clip 40 joined to the front side of the header 20 so as to cover the front side of an upper edge of the louver unit C; and a pair of vertical clip 45 joined one to the outside of each louver jamb so as to cover the outside of the lateral edge of the louver unit C.

U.S. Pat. No. 5,950,384

Inventor: James C. Aarness

Issued: Sep. 14, 1999

A sheet metal ventilation louver is fabricated out of two types of blades, a center and a top/bottom blade, that are shaped in a manner that permits their slidable engagement with an outer support frame. The side panels making up the outer frame are fabricated out of sheet metal rectangles that have been bent, with slots formed in the bent areas at locations enabling the slidable receipt of the blades within the side panel slots. An outer frame then fits around the side panels, retaining both the side panels and their received blades in position, completing the ventilation louver.

SUMMARY OF THE PRESENT INVENTION

The present invention discloses a louvered window insert comprising two louvered frame sections each having one vertical member with an upper and lower horizontal member extending from each end thereof and a plurality of louver blades extending horizontally therebetween. The distal ends of the horizontal members and louver blades of the first section have recesses to receive and slidably secure the horizontal members and louver blades of the second section as they travel therethrough allowing a user to size the insert to a window simply by placing the fully overlapped assembly inside an open window and separating the two frame sections thereby reducing the overlap of the horizontal members and the louvers and effectively elongating the insert until the two vertical members are flush to their respective side jambs and then lowering the window until it sits atop the present invention. An additional embodiment is provided wherein the louver blades are generally flat with one blade having curved edges for receiving the second blade. An additional embodiment discloses a storm window frame adapter along with a storm window track adapter. Also, a tensioning means is provided for securing the upper and lower horizontal frame members to each other.

A primary object of the present invention is to provide a telescoping louvered window insert that will overcome the shortcomings of prior art devices.

Another object of the present invention is to provide a telescoping louvered window insert to allow ventilation through an open window while preventing elements such as heavy rains from entering.

Still another object of the present invention is to provide a telescoping louvered window insert wherein the frame and louvers come in two sections of a similar length with the length of one section traveling within the recesses of the second section with at least some overlap to allow the user to nearly double the width of the insert from the fully overlapped position enabling the user to install one insert in windows of varying dimensions.

Yet another object of the present invention is to provide a telescoping louvered window insert that can be installed and removed quickly and easily by the user as needed.

A further object of the present invention is to provide a telescoping louvered window insert fabricated of a translucent or transparent material to allow light to pass through when the present invention is in use.

A still further object of the present invention is to provide a telescoping louvered window insert wherein the louvers could be pivotally or fixedly attached to the frame sections.

A yet further object of the present invention is to provide a telescoping louvered window insert wherein the first frame section has a vertical stabilizer bar extending distally from the upper horizontal member to the lower horizontal member and attached to the louvers to prevent the louver blades from sagging when in an extended position.

Another object of the present invention is to provide a telescoping louvered window insert having storm window track adapters which snap onto the outer sides of the vertical members of the two frame sections with each track adapter having a slot extending distally to rest against the exterior portion of a storm window frame when the present invention is installed.

Still another object of the present invention is to provide a telescoping louvered window insert having a storm window frame adapter having a bottom side with a window insert frame retaining recess that snaps onto the upper horizontal member of the first frame section and having an upper side with a storm window frame retaining recess to accept the bottom portion of a storm window frame when used in conjunction with the storm window track adapters.

Another object of the present invention is to provide a telescoping louvered window insert wherein the storm window frame adapter has protrusions which lock into corresponding recesses located on an upper portion of the horizontal member of the first frame section thereby securing the adapter to the frame.

One other object of the present invention is to provide a telescoping louvered window insert having a locking mechanism to prevent the second frame section from sliding within the first frame section when the assembly is in place until the operator disengages said locking mechanism for removal or adjustment of the present invention.

A yet further object of the present invention is to provide a telescoping louvered window insert that is simple and easy to use.

Another object of the present invention is to provide a telescoping louvered window insert that is economical in cost to manufacture.

One other object of the present invention is to provide a telescoping louvered window insert having a resistance or securing mechanism including but not limited to tension springs or pin and recess locks to inhibit unwanted travel of the second frame section within the first frame section.

Additional objects of the present invention will appear as the description proceeds.

To the accomplishment of the above and related objects, this invention may be embodied in the form illustrated in the accompanying drawings, attention being called to the fact; however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

LIST OF REFERENCE NUMERALS

Figure 1:
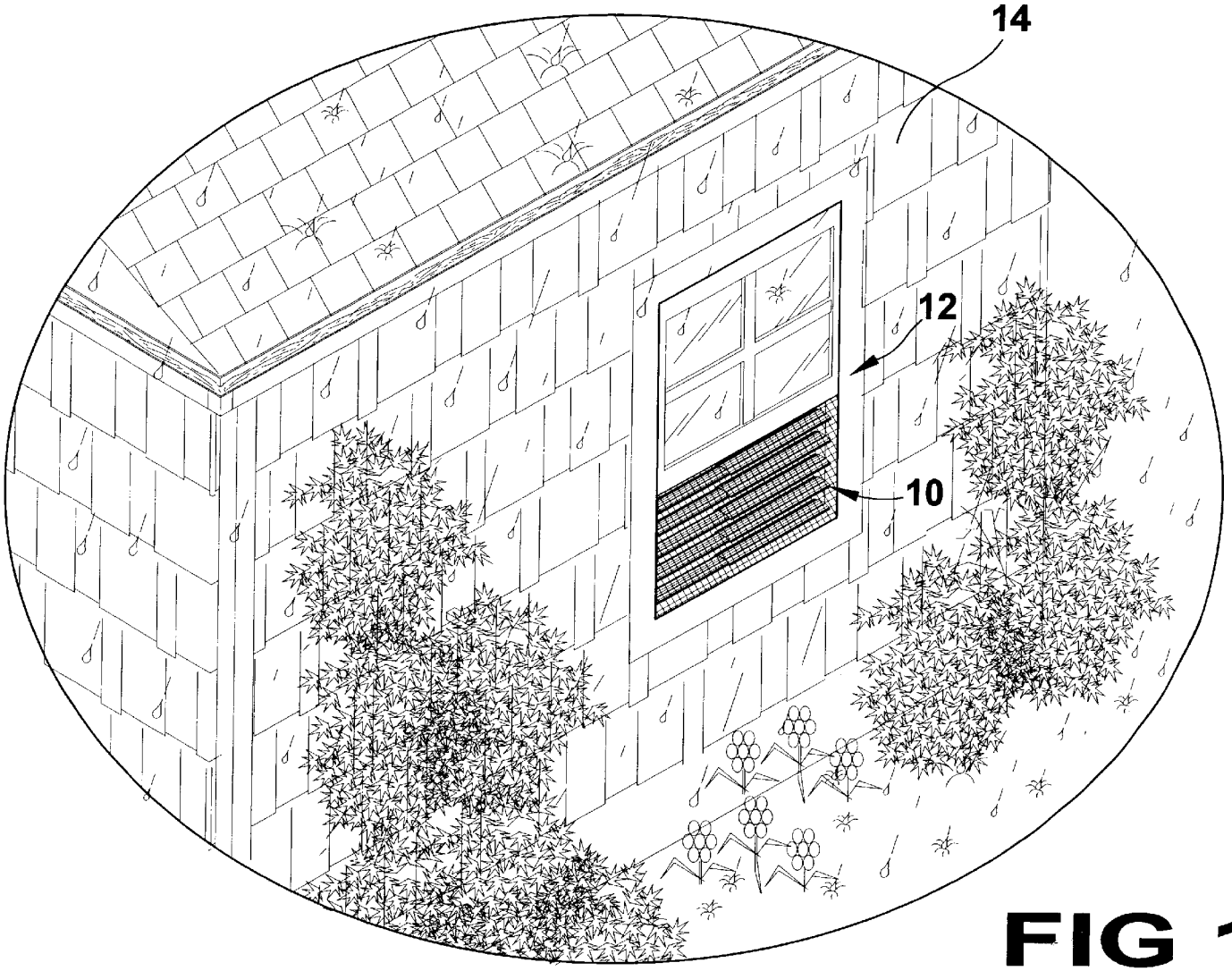
FIG. 1 is a perspective view of the present invention in use installed inside a double hung window.

With regard to reference numerals used, the following numbering is used throughout the drawings.

10 present invention
12 window
14 building
16 louver blades
18 inside window components
20 upper sash
22 lower sash

24 window pane
26 muntins
28 stop
30 sill
32 parting strip
34 outside window
36 stop
38 screen
39 first frame member
40 upper horizontal member of first frame
42 lower horizontal member of first frame
44 vertical member of first frame
46 louvers of first frame
48 cavity of louver
50 second frame member
52 louvers of second frame
54 cavity of first frame
56 upper horizontal member of second frame
58 lower horizontal member of second frame
60 vertical member of second frame
62 means for fastening
64 vertical stabilizer bar
66 securing pin
68 aperture
70 frame adapter
72 track adapter
74 flange
76 storm window recess
77 window insert frame recess
78 louver blade recess
80 locking protrusion
82 retaining clips
84 retaining clips
85 storm window track adapter retaining clip
86 storm window
88 tension means
89 fingers
90 rods
92 apertures
94 housing
96 spring
98 direction arrow

DESCRIPTION OF THE PREFERRED EMBODIMENT(S)

In order that the invention may be more fully understood, it will now be described, by way of example, with reference to the accompanying drawings in which FIGS. 1 through 18 illustrate the present invention being a telescoping louvered window insert.

Turning to FIG. 1, shown therein is a perspective view of the present invention 10 in use installed inside a double hung window 12 on a building 14. The present invention 10 relates generally to louvered window assemblies and, more specifically, to a louvered window insert having a telescoping horizontal frame and louver blades which would allow an installer to easily adjust the width of the insert to that of a window sash by placing it inside an open window 12 and sliding the opposing frame ends outward until the sides of the louver frame are flush against the side jambs of the window and then closing the window 12 until it sits atop the insert 10.

Figure 2:
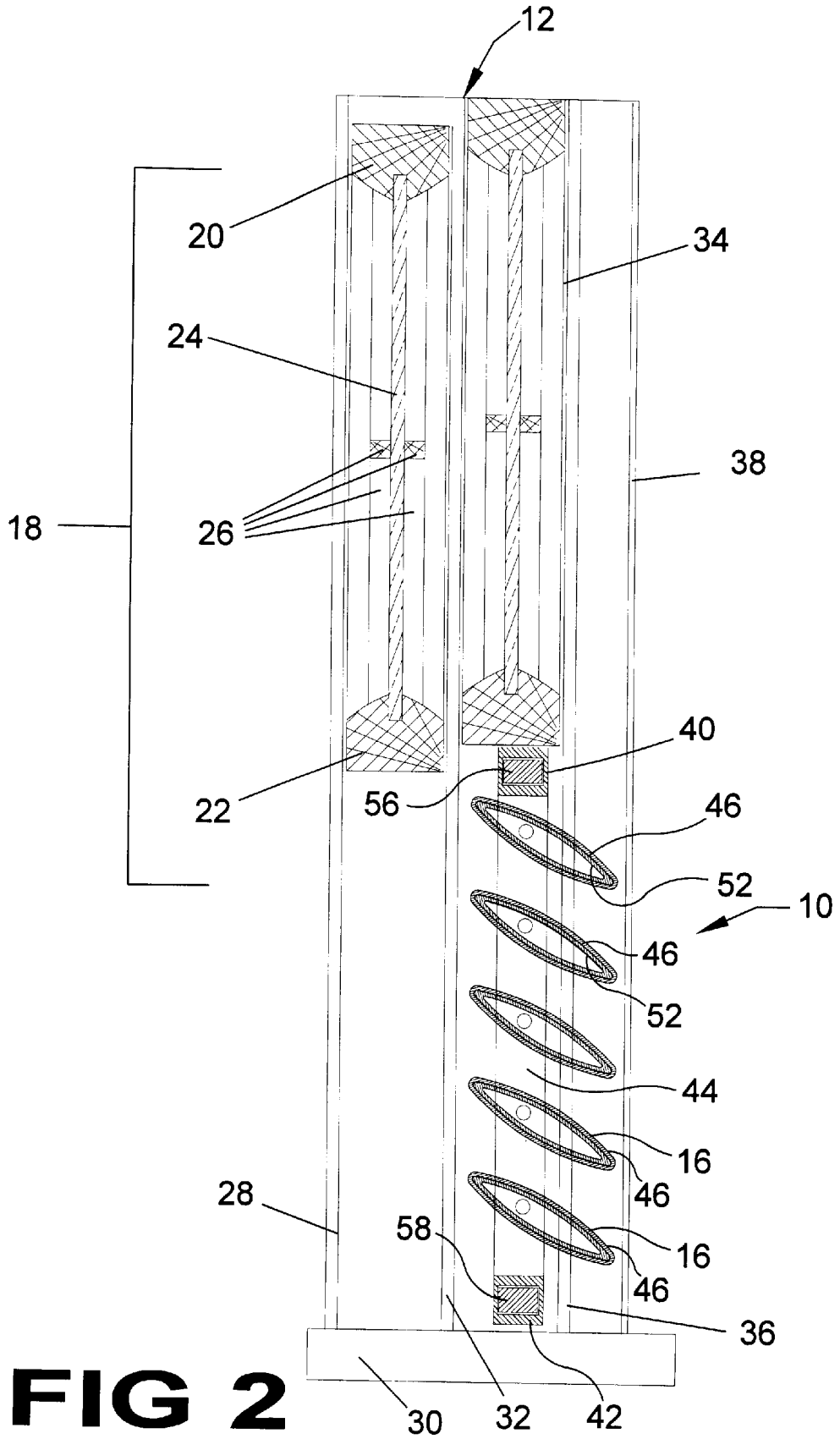
FIG. 2 cross-sectional side view of the present invention with arcuate louver blades installed within a double hung window.

Turning to FIG. 2, shown therein is a cross-sectional side view of the present invention 10 with multiple arcuate louver blades 16 installed within a double hung window 12. Shown are the inside window components 18 including an upper sash 20, a lower sash 22, window pane 24 and muntins 26 along with a stop 28, seal 30 and parting strip 32. Also shown is the outside window 34 and stop 36, along with the window screen 38. Also shown are the upper and lower horizontal frame members of the first frame 40, 42 along with the vertical member 44 of the first frame. Also shown are multiple louvers 46 of the first frame with multiple louvers 52 of the second frame installed therein. Also shown are the upper and lower vertical horizontal members 56, 58 of the second frame.

Figure 3:
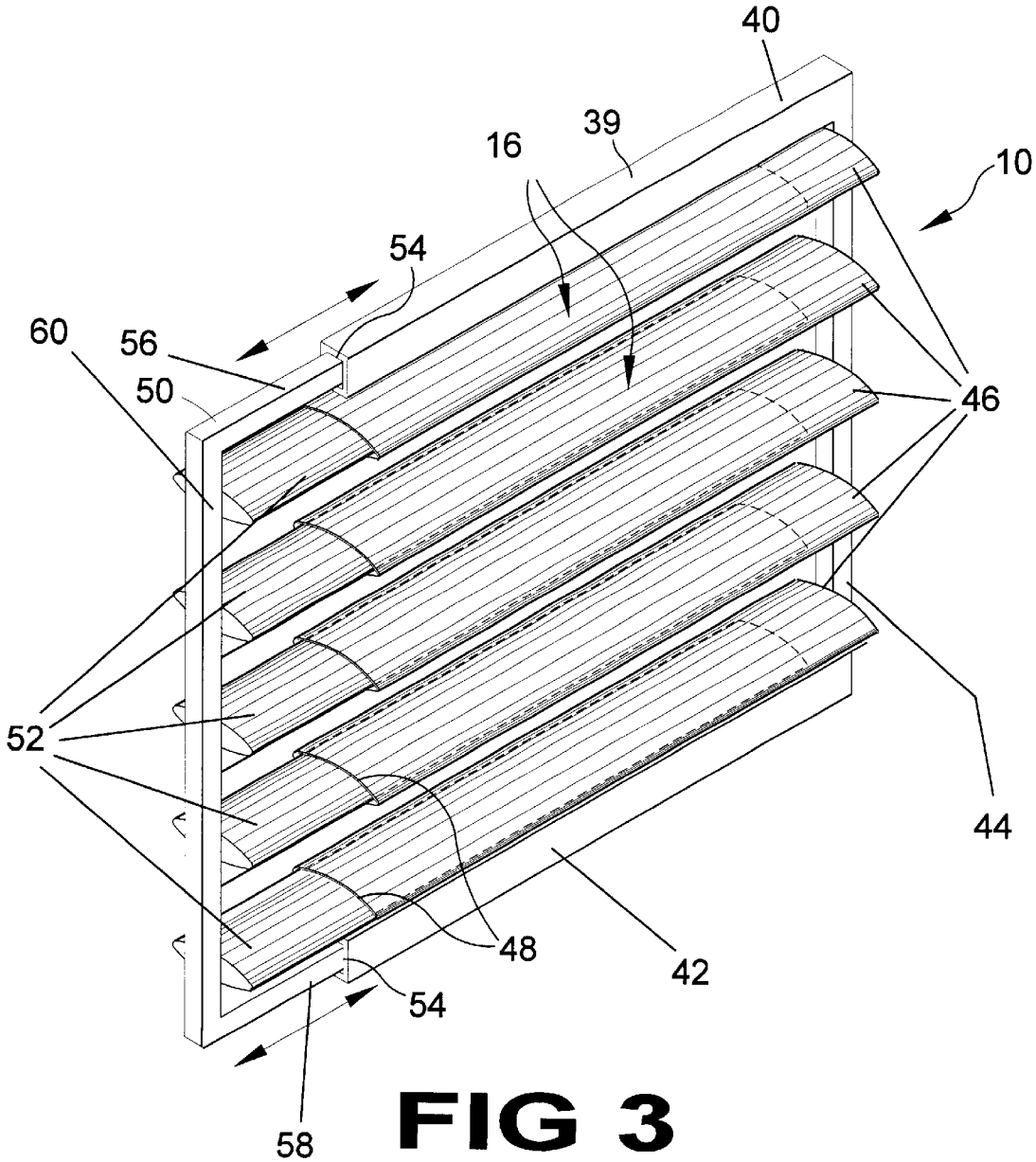
FIG. 3 is a perspective view of the present invention with arcuate louver blades.

Turning to FIG. 3, shown therein is a perspective view of the present invention 10 with arcuate louver blades 16. The telescoping louvered window insert 10 comprises a first frame section 39 having an upper horizontal member 40 and a lower horizontal member 42 connected to one another at one end by a vertical member 44 having a plurality of horizontal louver blades 46 fixedly or pivotally attached thereto to the first frame 39 with the distal end of each louver blade 46 having a recess or cavity 48 that extends longitudinally therethrough and a second frame member 50 having louver blades 52 of a size sufficient to slide securely within the recesses or cavities 48 of the corresponding louver blades 46 of the first frame sections 39. The horizontal members 40, 42 of the first frame section 39 have retaining cavities or recesses 54 to receive the horizontal members 56, 58 of the second frame section thereby allowing the width of the entire assembly to contract or expand as needed. Also shown is vertical member 60 of the second frame. The present invention 10 will provide windows with elemental protection when ventilation is desired and can be easily removed and installed in various sized windows as needed. The present invention could also be fabricated of a translucent or transparent material so as to provide the passage of light through the telescoping louvered window insert 10.

Figure 4:
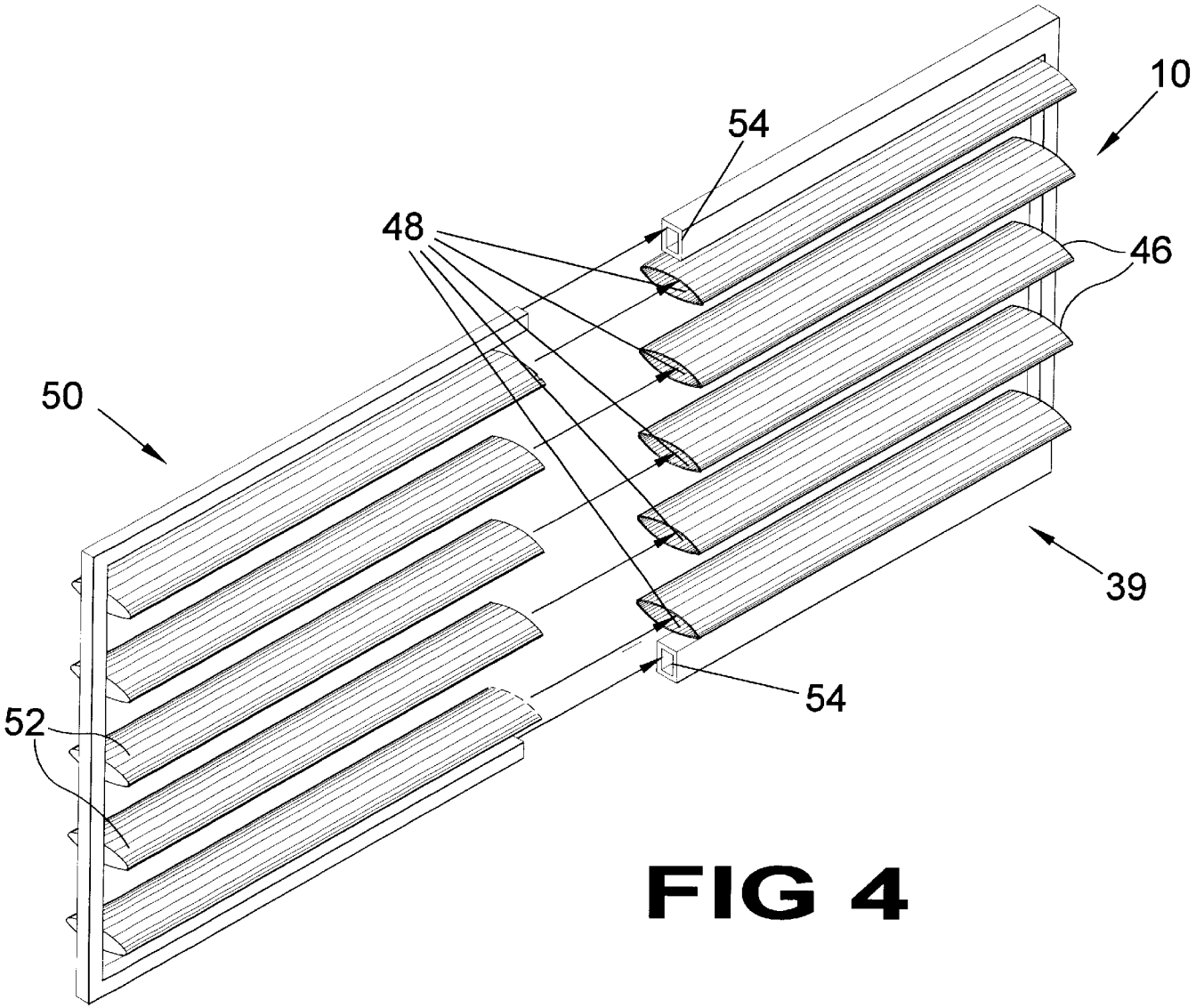
FIG. 4 is an exploded perspective view of the present invention with arcuate louver blades.

Turning to FIG. 4, shown therein is an exploded perspective view of the present invention 10 with arcuate louver blades 46, 52. Also shown is the first frame member 39 along with the second frame member 50 showing the receiving cavities 54 along with the multiple cavities 48 of the first frame section louver members 46.

Figure 5:
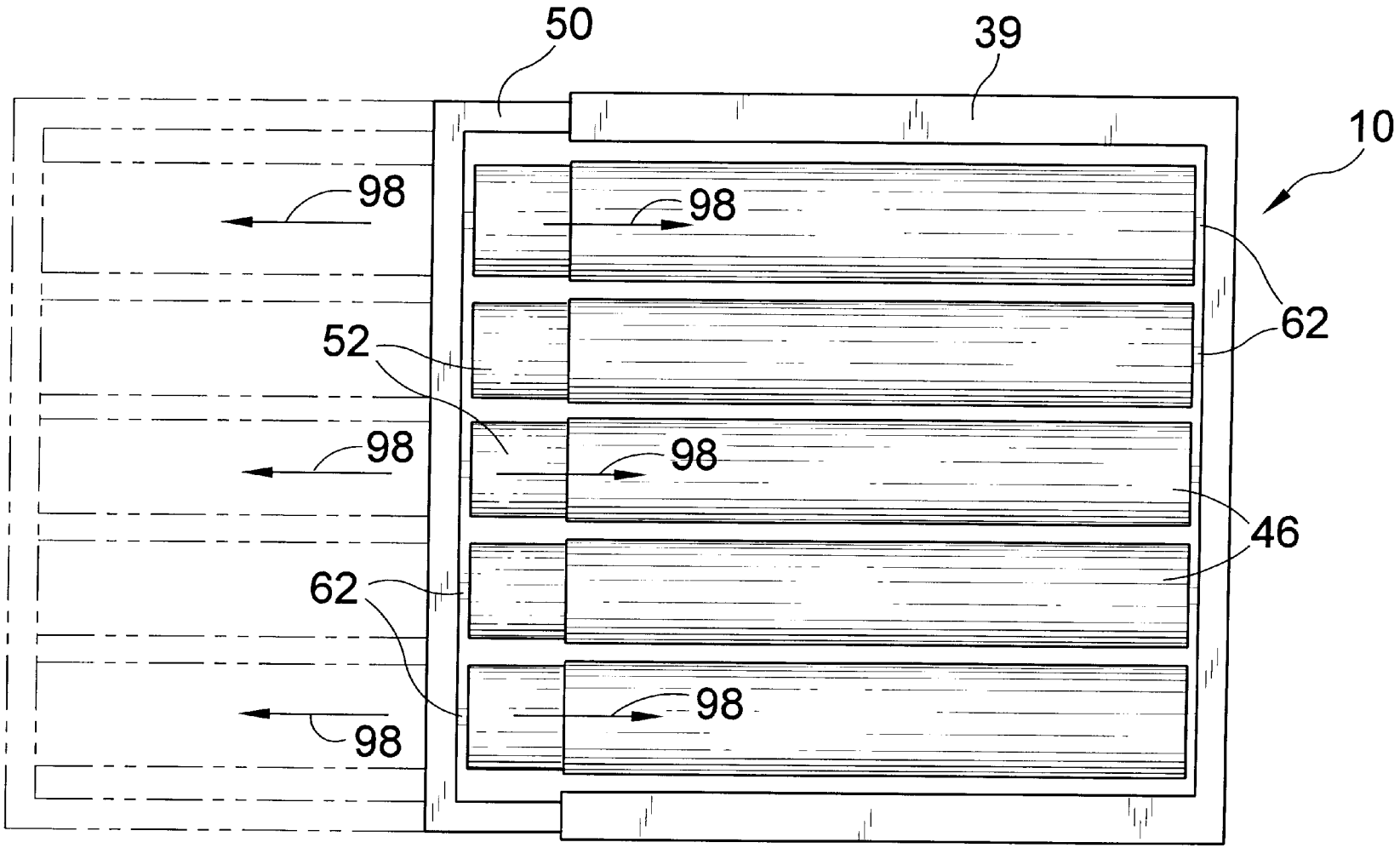
FIG. 5 is a front view of the present invention with arcuate louver blades demonstrating the telescoping action of the present invention with the fully extended position shown in phantom line.

Turning to FIG. 5, shown therein is a front view of the present invention 10 with arcuate louver blades 46, 52 demonstrating with direction arrows 98 the telescoping action of the present invention with the fully extended position shown in phantom line. Also shown are attachment means 62 for fastening louvers 46, 52 to their respective frame sections wherein means 62 could be either fixed or pivoting. Other elements previously disclosed are also shown.

Figure 6:
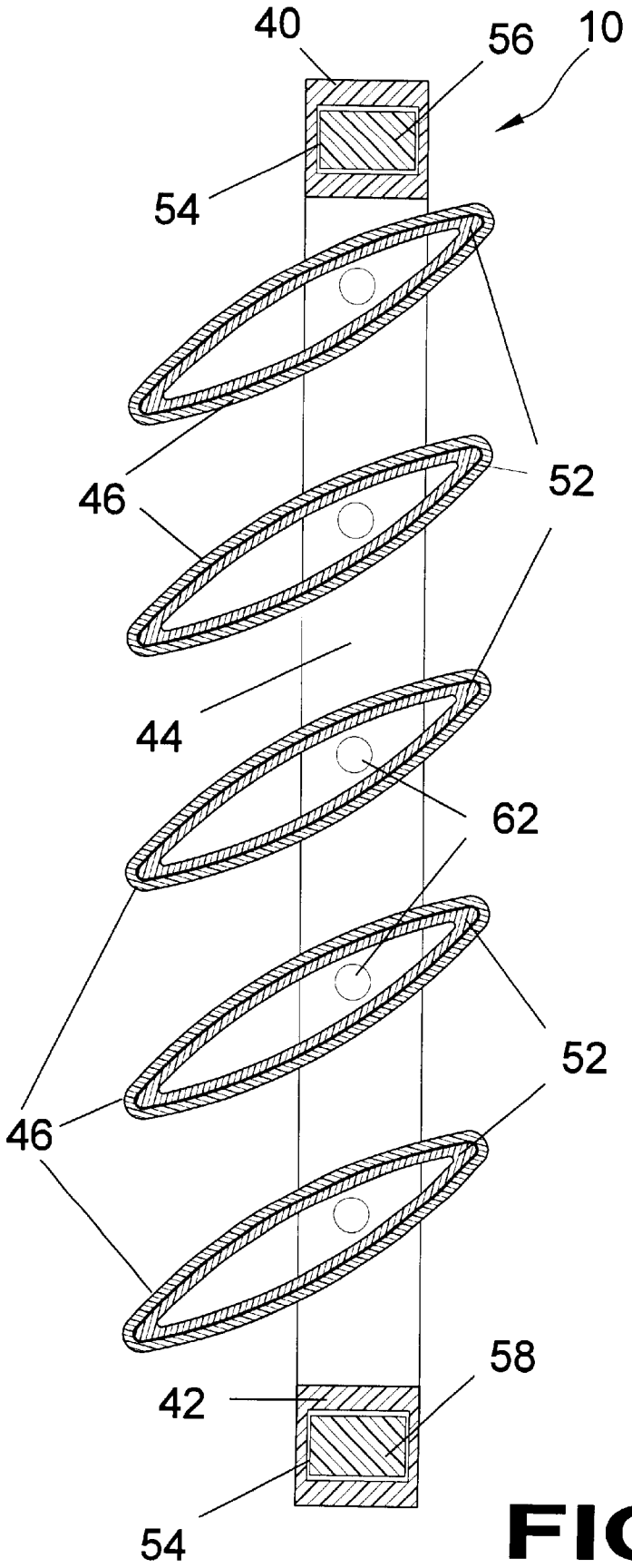
FIG. 6 is a detailed cross-sectional side view of the present invention with arcuate louver blades.

Turning to FIG. 6, shown therein is a detailed cross-sectional side view of the present invention 10 with arcuate louver blades 46, 52. Shown therein are the arcuate louvers of the first frame section 46 along with the arcuate louvers of the second frame section 52. Also shown are attachment means 62 for fastening louvers 46, 52 to their respective frame sections wherein means 62 could be either fixed or pivoting. Also shown are the upper horizontal members of the first frame 40, 42 having a cavity 54 therein for receiving the horizontal members 56, 58 of the second frame section. Vertical member 44 is also shown.

Figure 7:
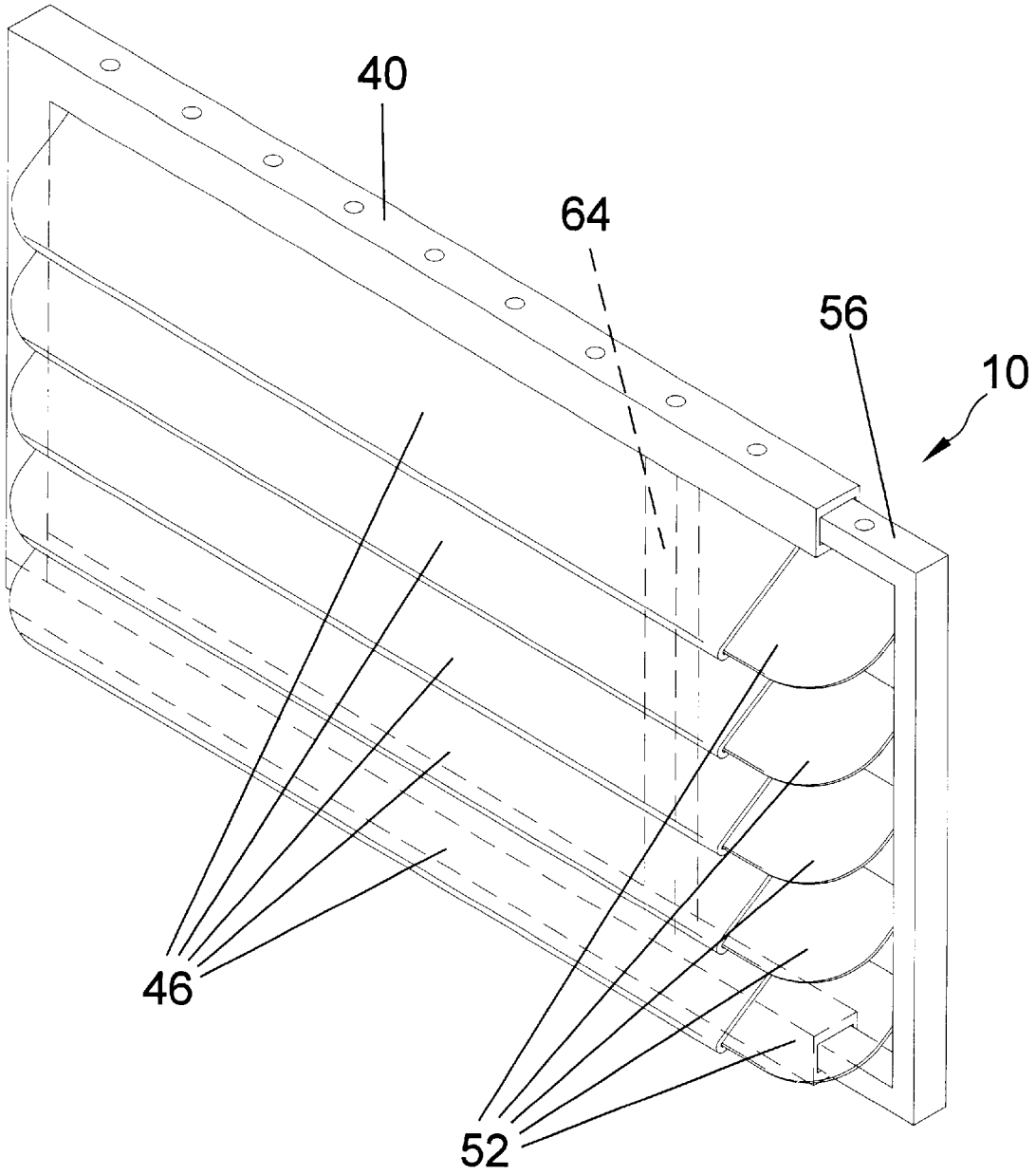
FIG. 7 is a perspective view of the present invention with interlocking louver blades showing the vertical stabilizer bar depicted in hidden line.

Turning to FIG. 7, shown therein is a perspective view of the present invention 10 with interlocking louver blades 46, 52 showing the vertical stabilizer bar 64 depicted in hidden line. Shown are the louver blades of the first frame 46 and the louver blades of the second frame section 52, along with the horizontal member of the first frame section 40 and the horizontal member of the second frame section 56.

Figure 8:
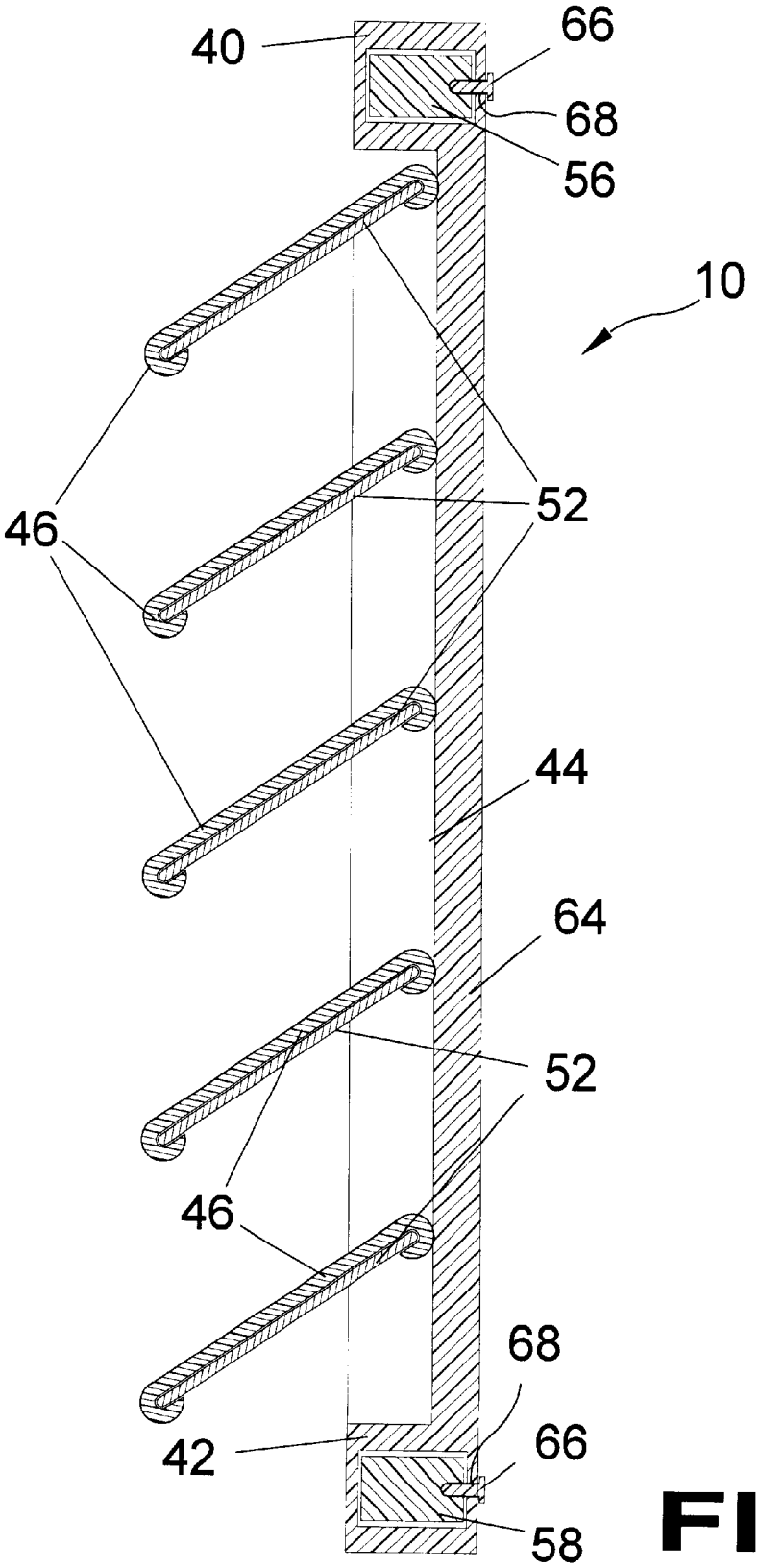
FIG. 8 is a cross-sectional side view of the present invention with interlocking louver plates wherein the locking mechanism is a securing pin that slides into aligned recesses in the horizontal members of the first and second frame sections to maintain the present invention at a desired width until said securing pin is removed. The louvers of the first frame section are adhered to the vertical stabilizer bar.

Turning to FIG. 8, shown therein is cross-sectional side view of the present invention 10 with interlocking louver plates 46, 52 wherein the locking mechanism is a securing pin 66 that slides into aligned apertures or recesses 68 in the horizontal members of the first and second frame sections 40, 56 and 42, 58 to maintain the present invention 10 at a desired width until the securing pin 66 is removed. The louvers of the first frame section 46 are adhered to the vertical stabilizer bar 64. Vertical member 44 is also shown.

Figure 9:
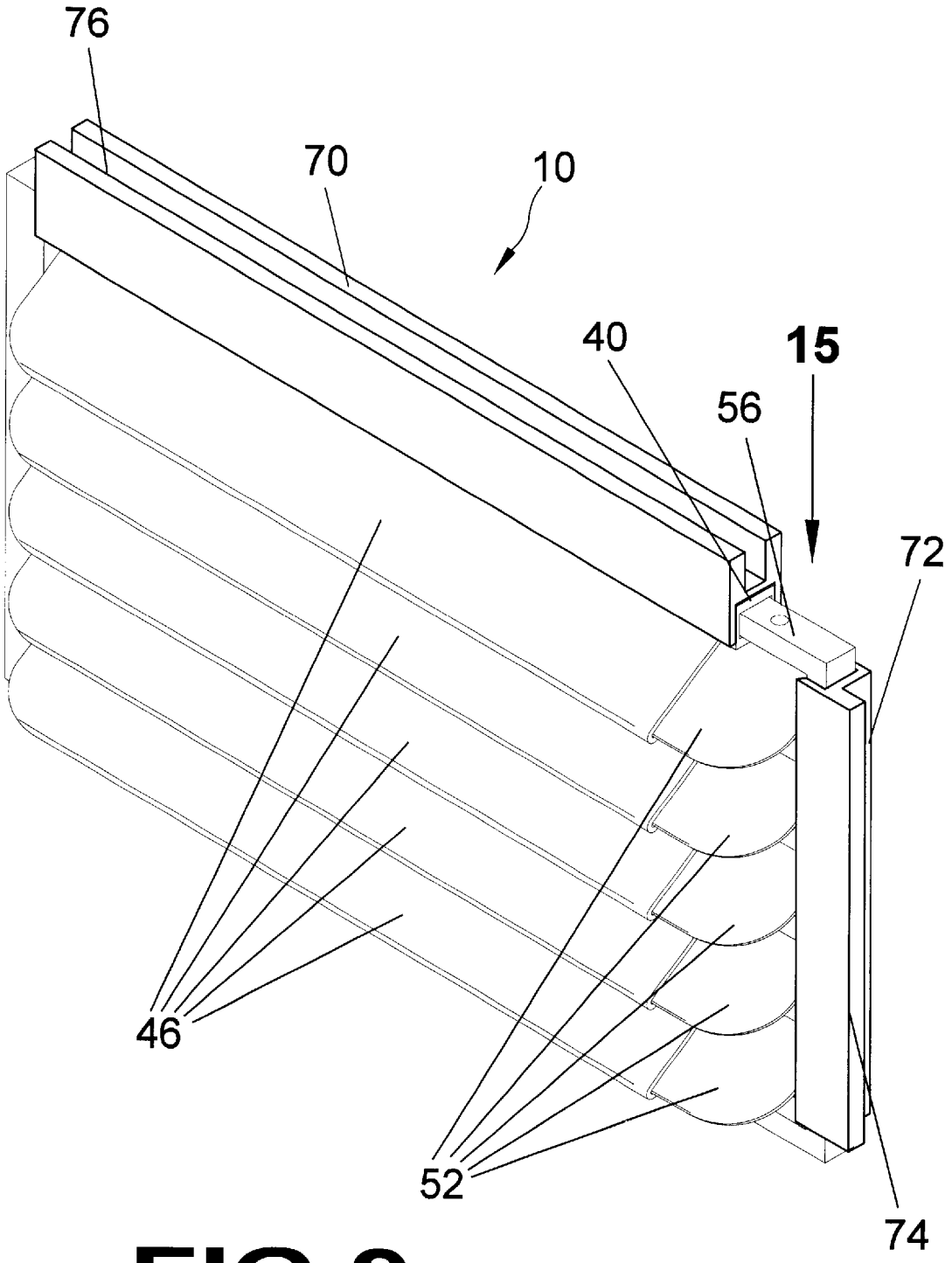
FIG. 9 is a perspective view of the present invention with a storm window frame adapter and a storm window track adapter in place on the frame assembly. The present invention could be installed within the frame of a storm window when needed by fastening track adapters to the opposing vertical members of the frame sections and snapping the storm window frame adapter to the horizontal member of the first frame section. The present invention is then placed on the storm window's bottom track and the vertical members are slid apart until the slots of the track adapters are resting within the side tracks for the storm window. The storm window is then lowered until the frame of said storm window is residing within the storm window frame retaining recess of the frame adapter thereby effectively securing the present invention in place.

Turning to FIG. 9, shown therein is a perspective view of the present invention 10 with a storm window frame adapter 70 and a storm window track adapter 72 in place on the frame assembly. The present invention 10 could be installed within the frame of a storm window (not shown) when needed by fastening track adapters 72 to the opposing vertical members of the frame sections and snapping the storm window frame adapter 70 to the horizontal member of the first frame section 40. The present invention 10 is then placed on the storm window's bottom track and the vertical members are slid apart until the outwardly extending flange 74 of the track adapters 72 are resting within the side tracks for the storm window. The storm window is then lowered until the frame of the storm window is residing within the storm window frame retaining recess 76 of the frame adapter 70 thereby effectively securing the present invention 10 in place. Other elements previously disclosed are also shown.

Figure 10:
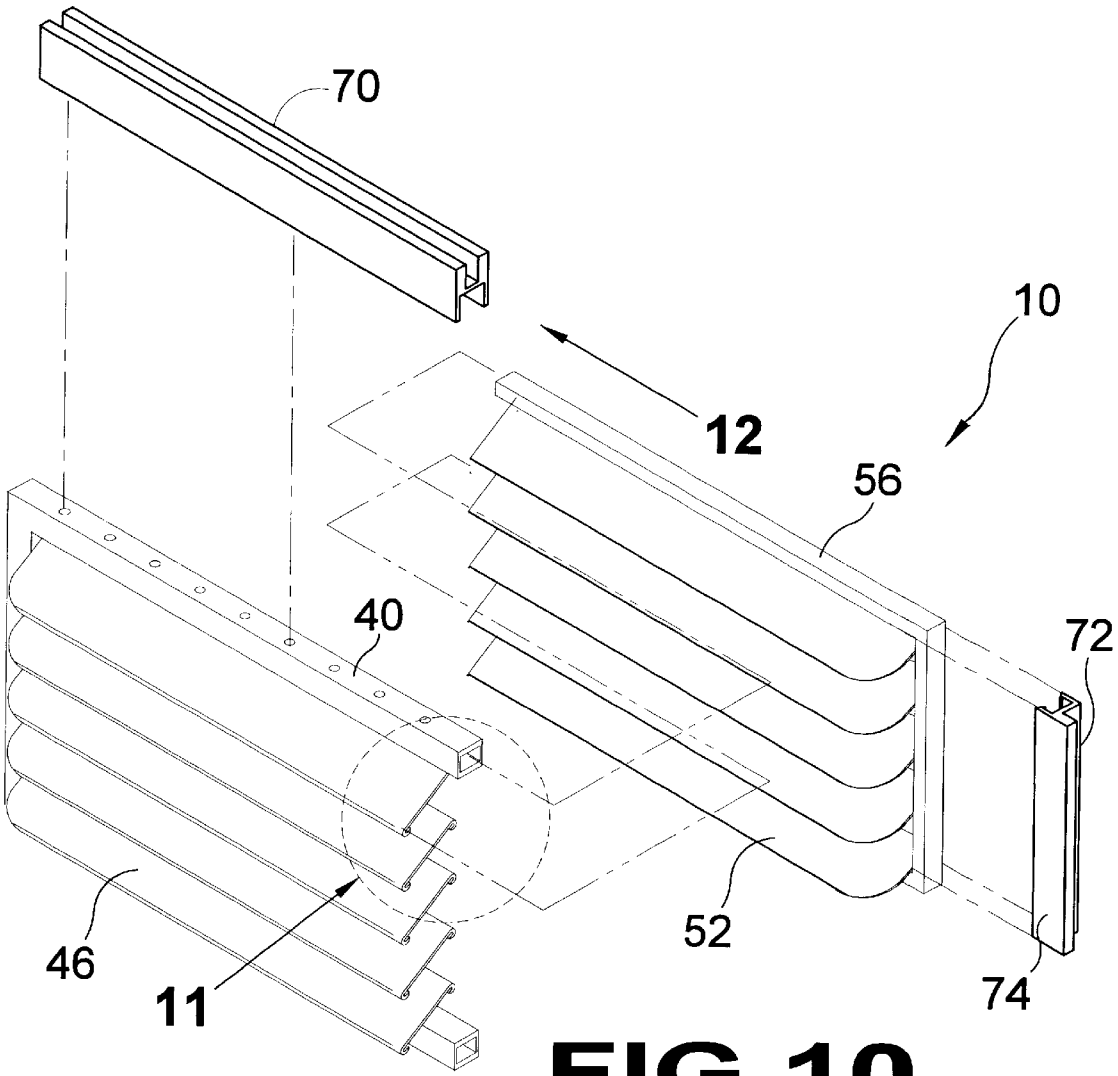
FIG. 10 is an exploded perspective view of the present invention with interlocking louver blades and storm window adapters.

Turning to FIG. 10, shown therein is an exploded perspective view of the present invention 10 with interlocking louver blades 46, 52 and storm window adapters 70, 72. Other elements previously disclosed are also shown.

Figure 11:
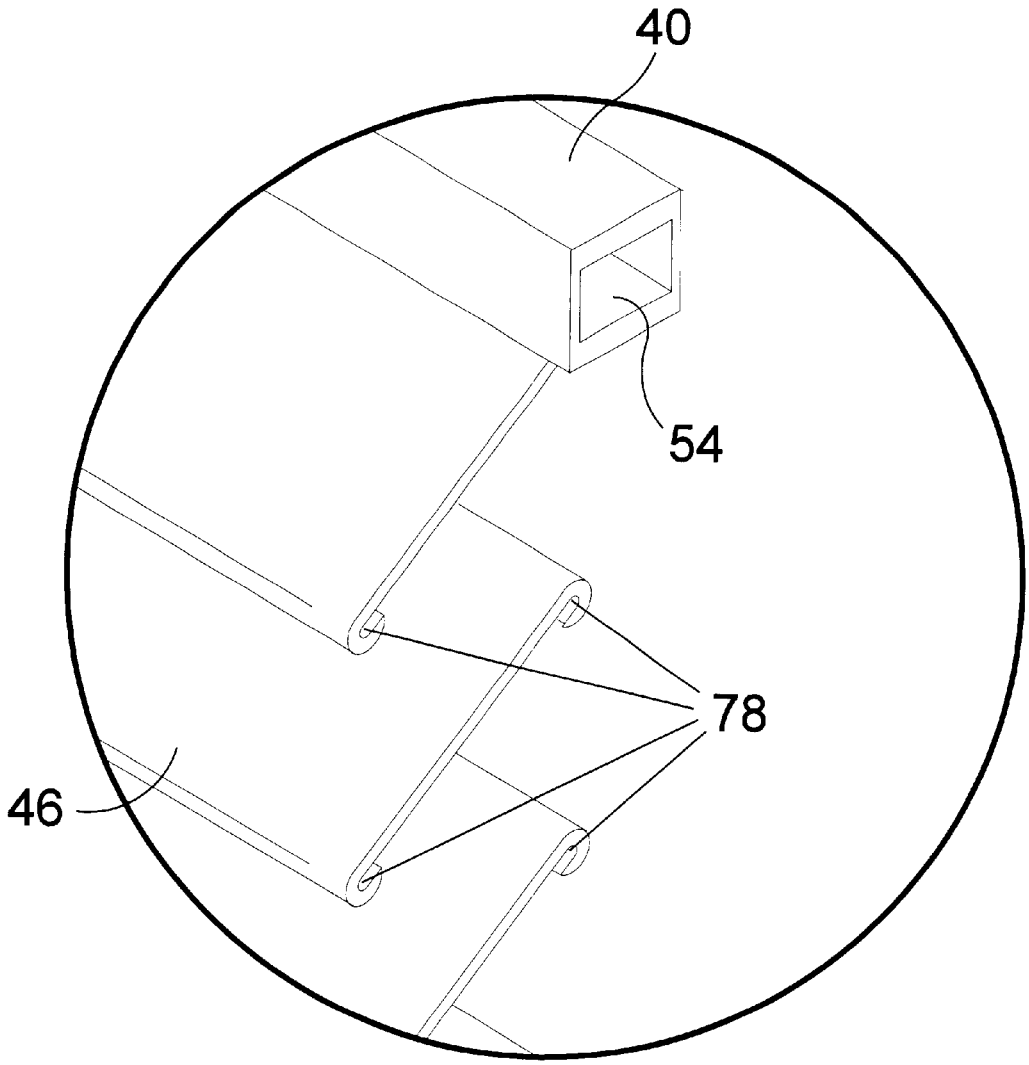
FIG. 11 is a detailed view showing the retaining recesses in the louver blades and the horizontal member of the first frame section taken from FIG. 10 as indicated.

Turning to FIG. 11, shown therein is a detailed view showing the retaining recesses 78 being curved edges in the louver blades 46 and recess 54 in the horizontal member 40 of the first frame section taken from FIG. 10 as indicated.

Figure 12:
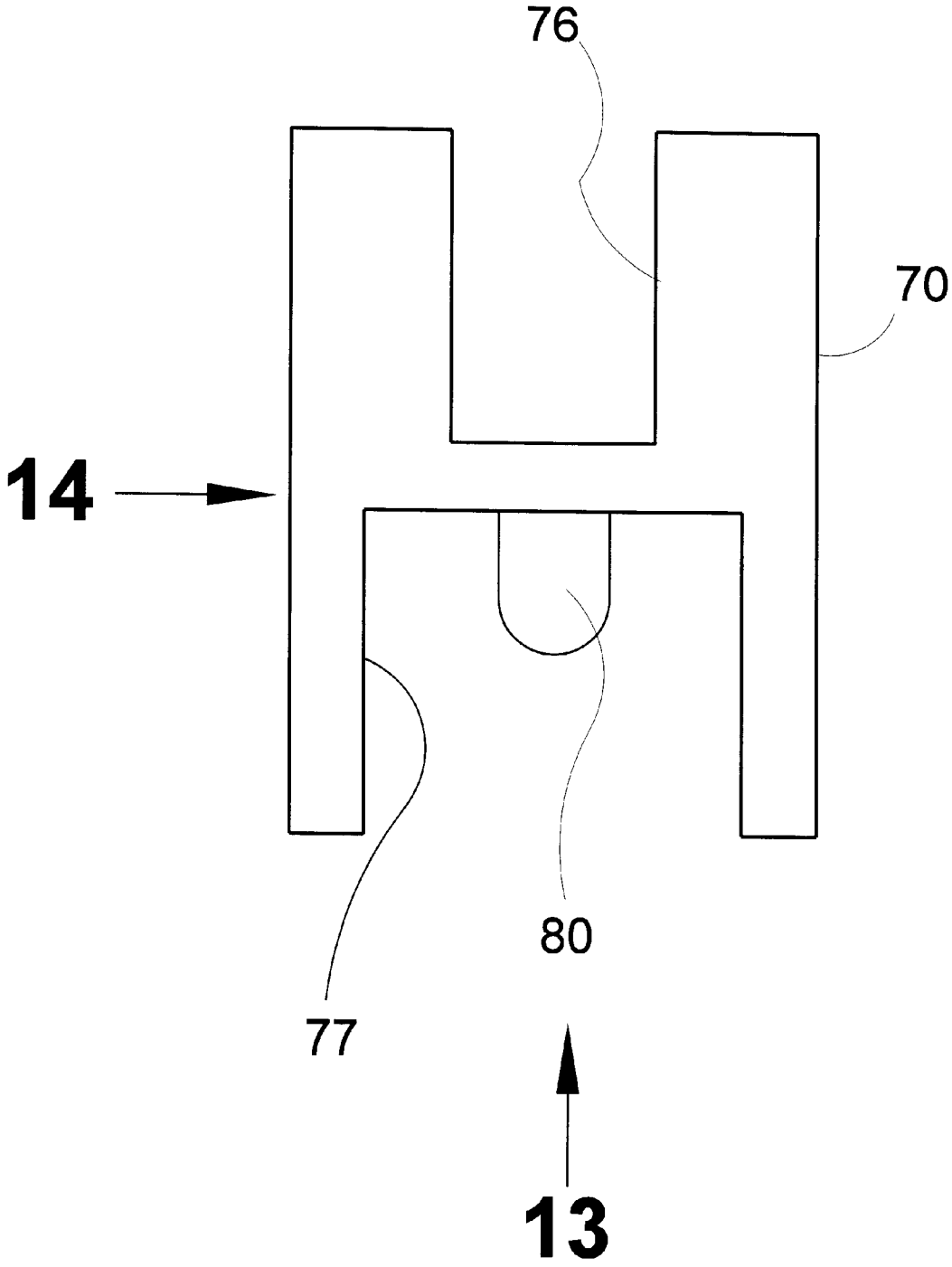
FIG. 12 is a side view of a storm window frame adapter taken from FIG. 10 as indicated; shown are the retaining recesses to receive the storm window frame and the window insert frame and locking protrusion for securing the adapter to the window insert frame.

Turning to FIG. 12, shown therein is a side view of a storm window frame adapter 70 taken from FIG. 10 as indicated. Shown are the "H" shaped adapter having an upper retaining recess 76 to receive the storm window frame and the lower window insert frame retaining recess 77 and locking protrusion 80 for securing the adapter 70 to the window insert frame.

Figure 13:
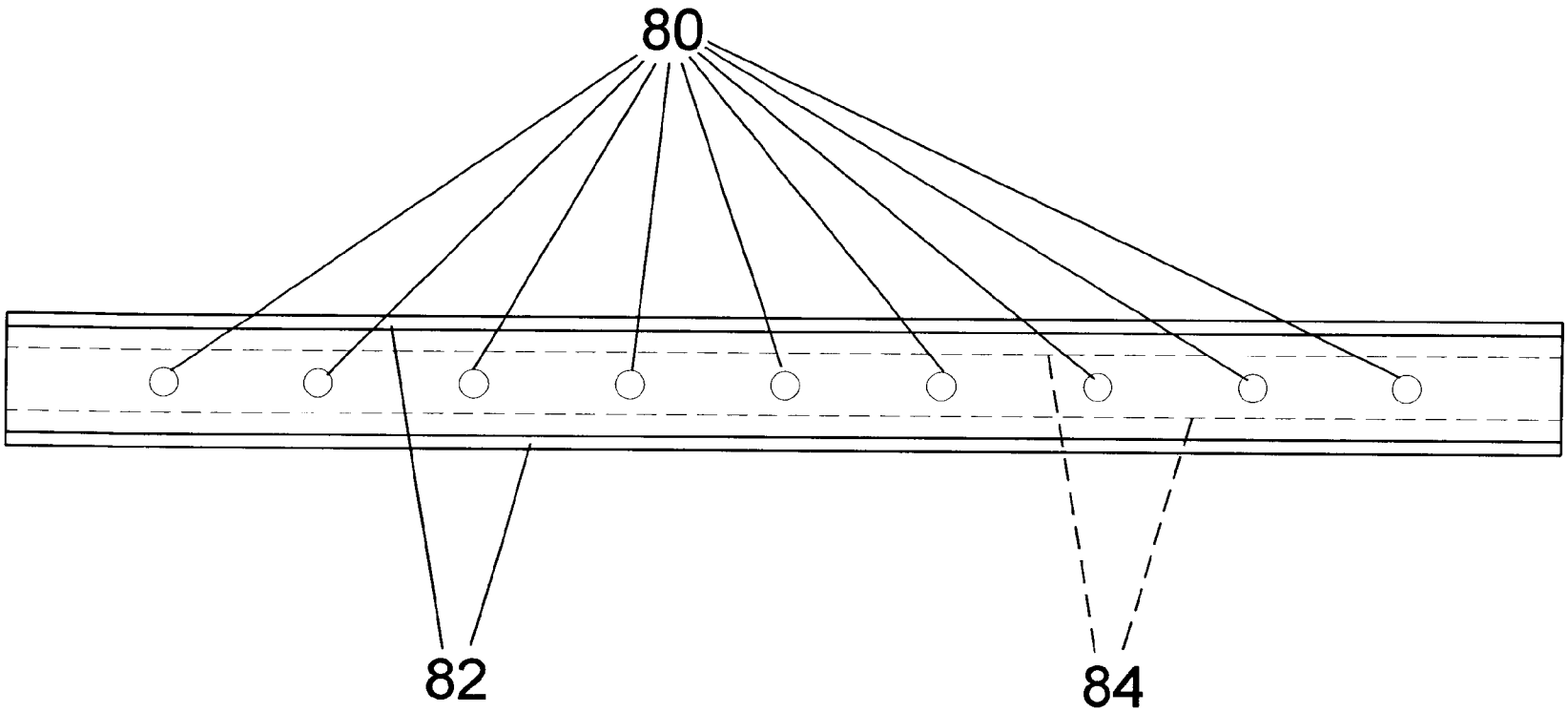
FIG. 13 is a side view of a storm window frame adapter taken from FIG. 12 as indicated.

Turning to FIG. 13, shown therein is a bottom view of a storm window frame adapter 70 taken from FIG. 12 as indicated. Shown are multiple locking protrusions 80 along with window insert frame retaining clips 82 and the storm window frame retaining clips 84.

Figure 14:
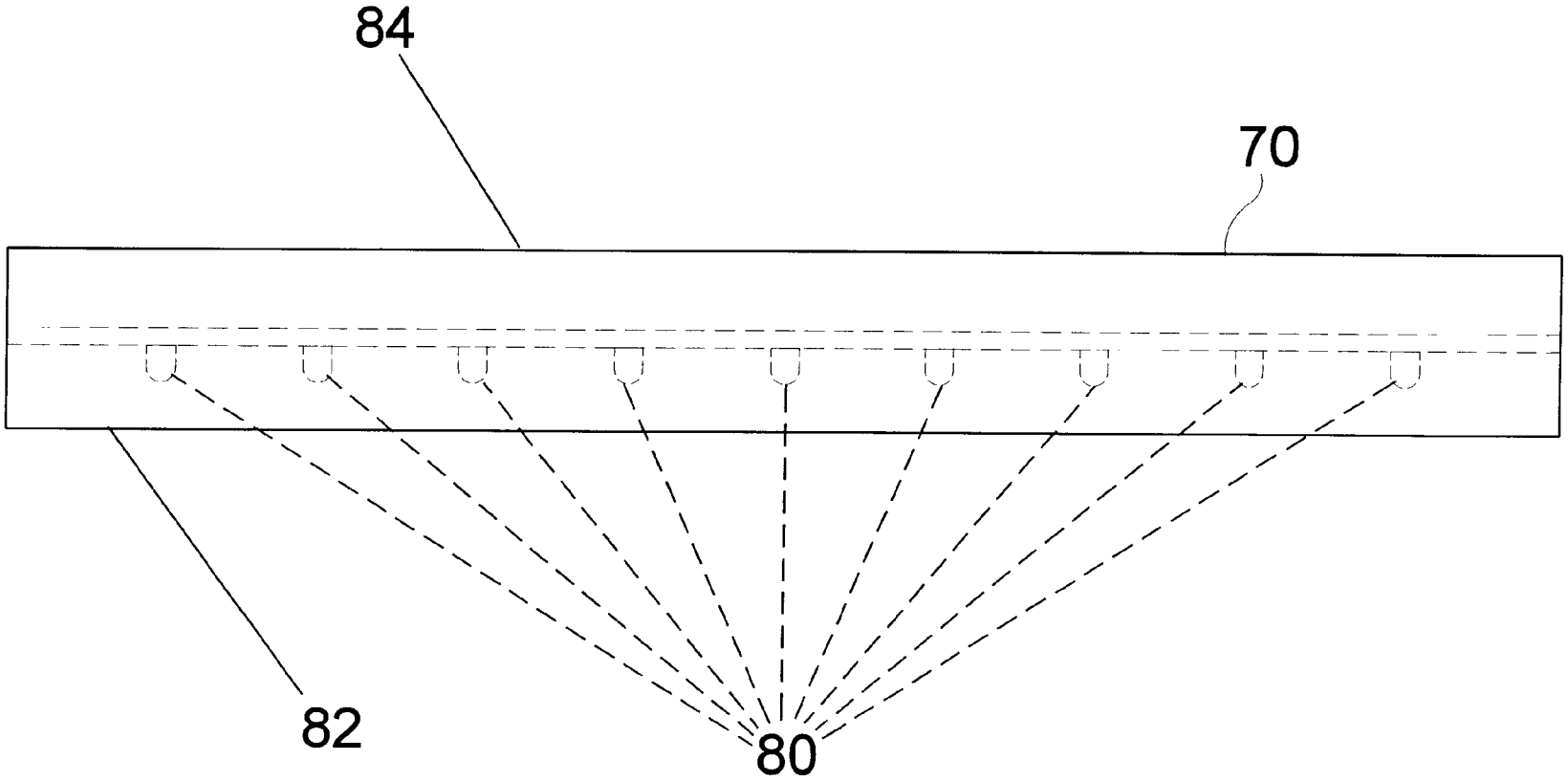
FIG. 14 a front view of storm window frame adapter taken from FIG. 12 as indicated.

Turning to FIG. 14, shown therein is a front view of storm window frame adapter 70 taken from FIG. 12 as indicated. Other elements previously disclosed are also shown.

Figure 15:
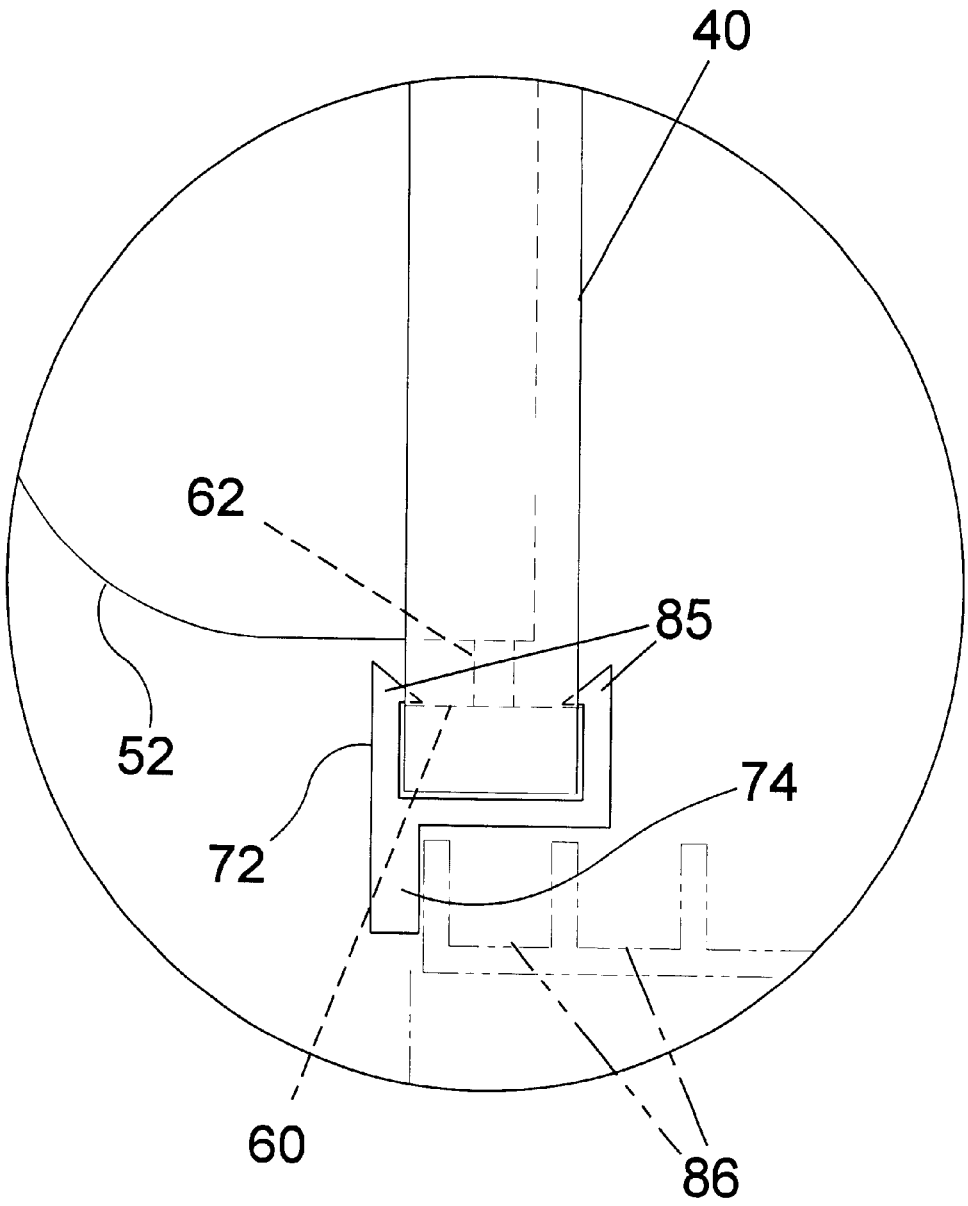
FIG. 15 is a top view of a storm window track adapter attached to the vertical member of the second frame section and the insertion slot in place against the exterior frame of the storm window.

Turning to FIG. 15, shown therein is a top view of a storm window track adapter 72 being "U" shaped on one end attached to the vertical member 60 of the second frame section and the outwardly extending insertion flange 74 on a second end in place against the exterior frame of the storm window 86. Also shown is the storm window track adapter retaining clip means 85. Other elements previously disclosed are also shown.

Figure 16:
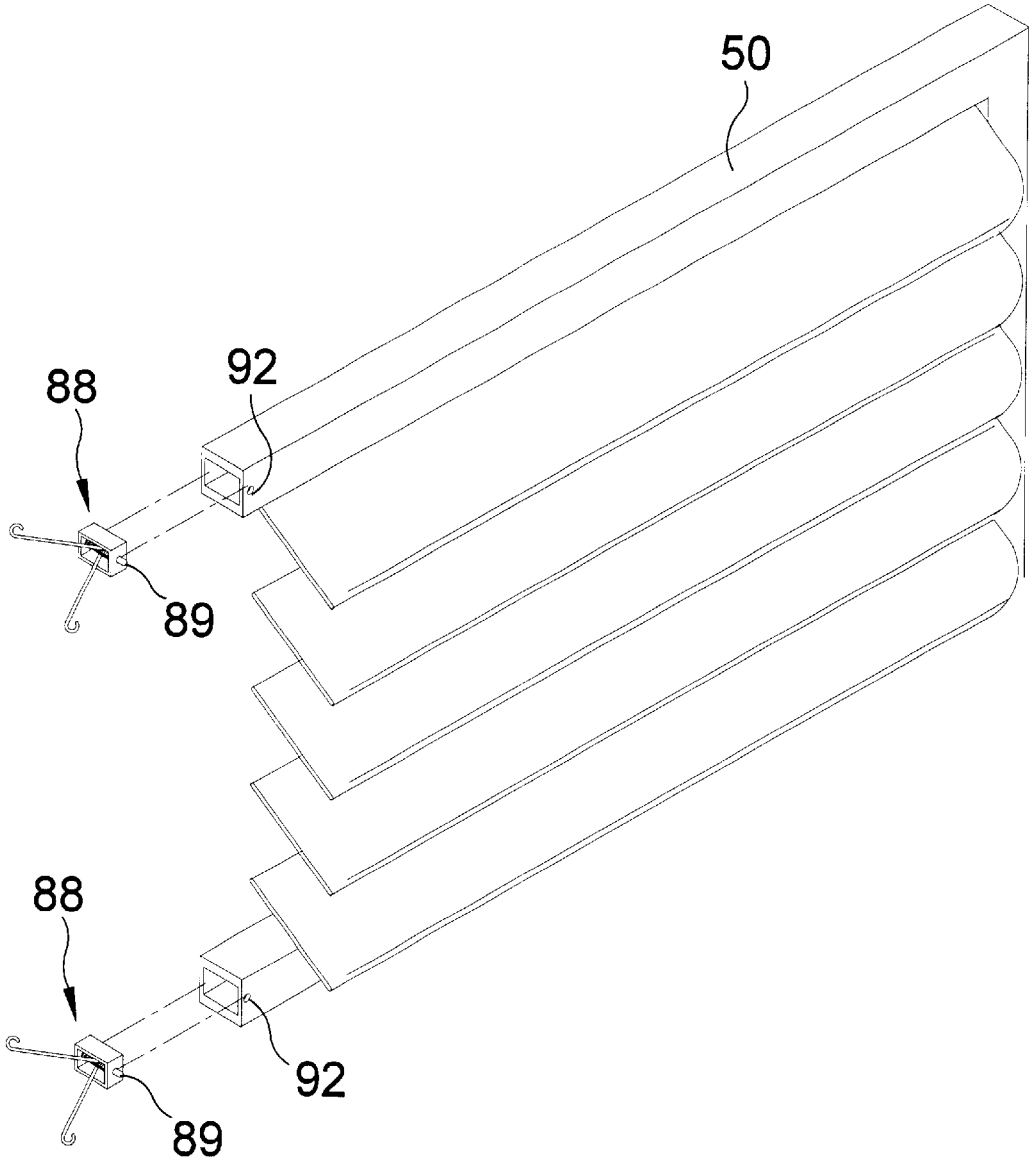
FIG. 16 is an exploded perspective view of the second frame section showing a resistance means utilizing two replaceable tension spring inserts that are placed within the recesses of the horizontal members and secured by spring loaded insertion clips that lock into recesses in the vertical walls of said second frame section.

Turning to FIG. 16, shown therein is an exploded perspective view of the second frame section 50 showing a resistance means utilizing two replaceable tension spring inserts 88 that are placed within the recesses of the hollow tubular horizontal members and secured by spring loaded insertion fingers 89 that lock into apertures 92 in the vertical walls of said second frame section 50.

Figure 17:
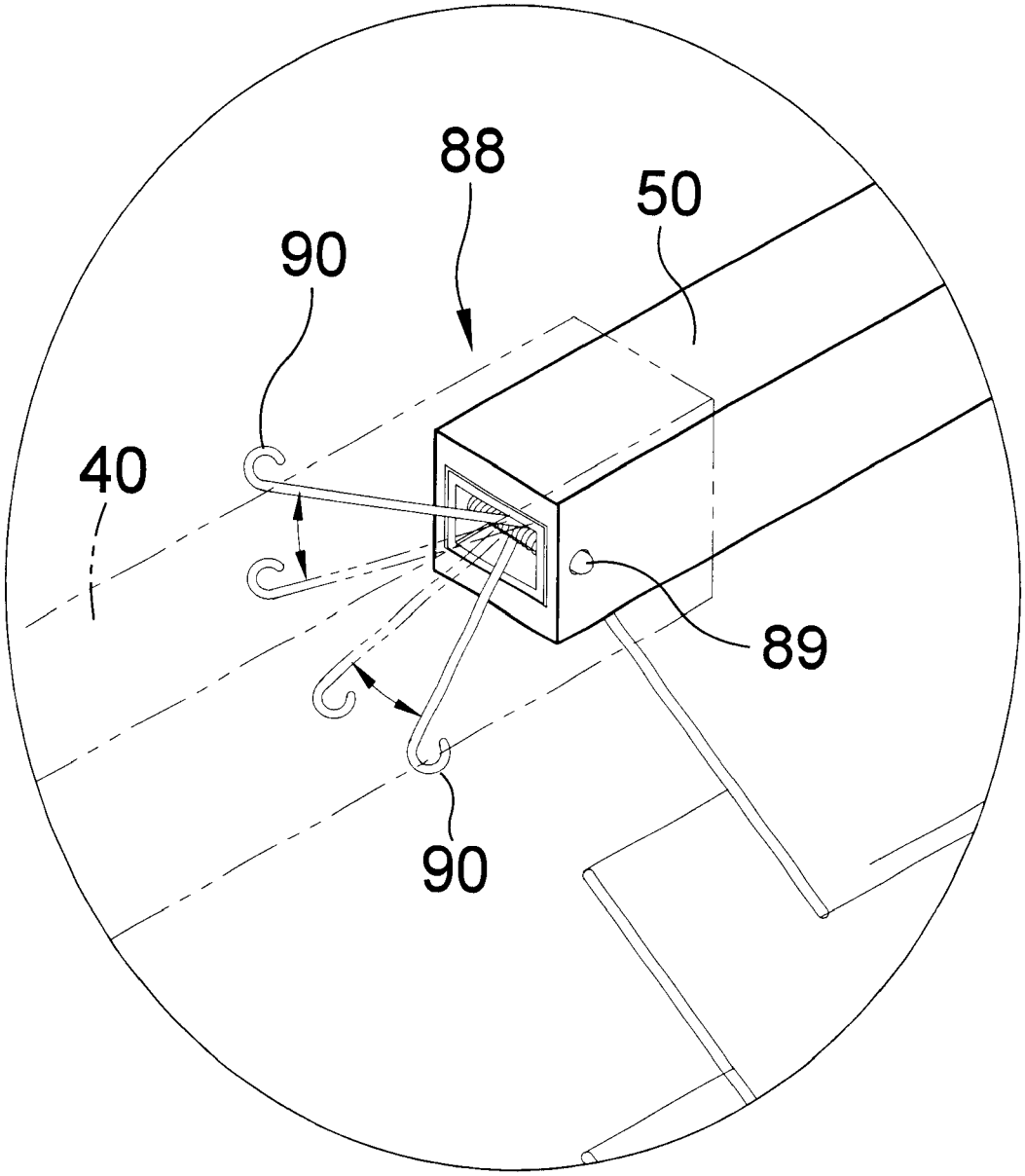
FIG. 17 is a perspective view of a replaceable tension spring insert installed within the horizontal member of the second frame section and secured by the spring loaded tension clips. The placement of the horizontal member of the first frame section when installed and the resulting compression of the tension rods to provide resistance is indicated in phantom line.

Turning to FIG. 17, shown therein is a perspective view of a replaceable tension spring insert 88 installed within the horizontal member of the second frame section 50 and secured by the spring loaded tension fingers 89. The placement of the horizontal member of the first frame section 40 when installed and the resulting compression of the tension rods 90 to provide resistance is indicated in phantom line. The operator will squeeze the rods 90 together prior to insertion into the horizontal member 40 of the first frame where the clips 90 will be oppositely biased against opposing interior walls thereof.

Figure 18:
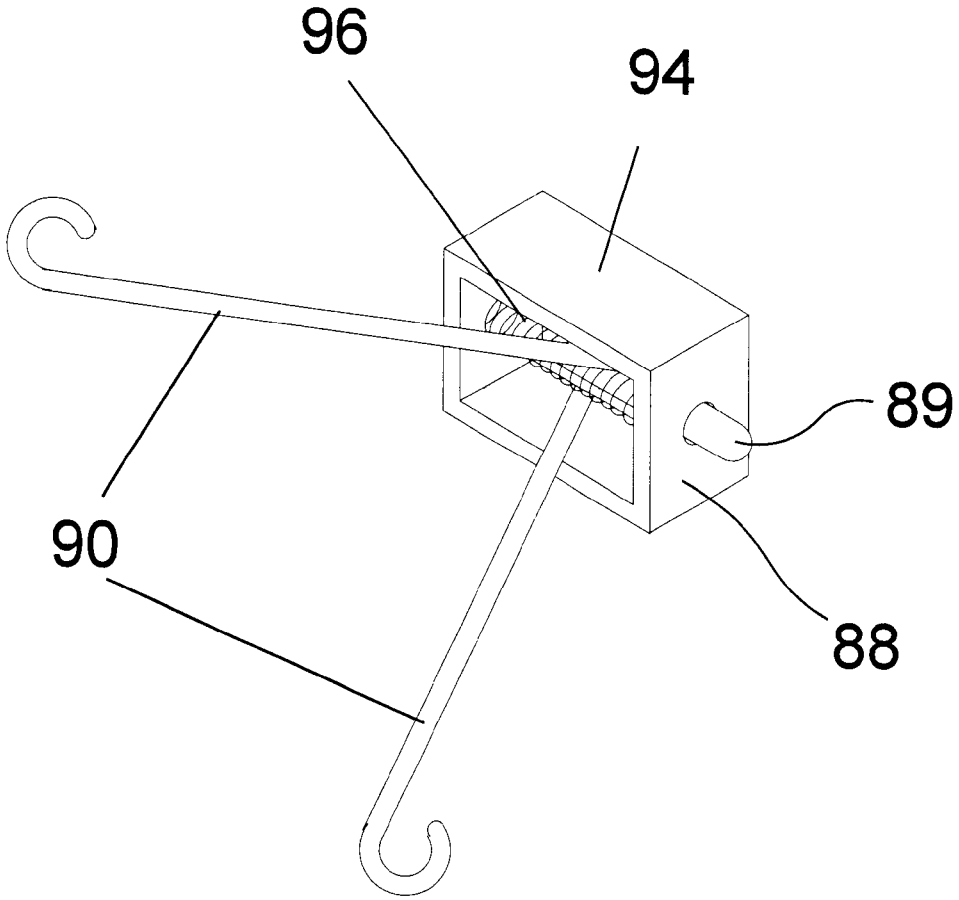
FIG. 18 is a perspective view of a replaceable tension spring insert.

Turning to FIG. 18, shown therein is a perspective view of a replaceable tension spring insert 88. Elements previously disclosed are shown including the housing 94 and tension spring 96.

I claim:

1. An apparatus for a telescoping louvered window insert, comprising:

a) a first frame member having an upper horizontal frame member, a lower horizontal frame member, and a vertical frame member, said vertical frame member connecting a first end of said upper and lower horizontal frame members;

b) said first frame member having a cavity therein;

c) a second frame member having an upper horizontal frame member, a lower horizontal frame member, and a vertical frame member, said vertical frame member connecting a first end of said upper and lower horizontal frame members;

d) said second frame member having a cavity therein;

e) said second end of said upper and lower horizontal first frame members slidably receiving a second end of said upper and lower horizontal second frame members, a rectangular frame being thereby formed;

f) a plurality of first arcuate louver blades disposed within said rectangular frame, said plurality of first louver blades having means for attachment to said vertical first frame member, said plurality of blades disposed parallel to said upper and lower horizontal first frame members;

g) said first arcuate louvered blade having a cavity therein;

h) a plurality of second arcuate louver blades disposed within said rectangular frame, said plurality of first louver blades having means for attachment to said vertical second frame member, said plurality of blades disposed parallel to said upper and lower horizontal second frame members; and, i) said second arcuate louver blades slidably disposed internally of said first arcuate louver blades.

2. The apparatus of claim 1, wherein said means for attachment is fixed.

3. The apparatus of claim 1, wherein said means for attachment is pivotable.

4. The apparatus of claim 1, wherein said upper and lower first frame horizontal members and said upper and lower second frame horizontal members are complementarily sized to be slidably fixed to each other.

5. The apparatus of claim 1, wherein said first and second arcuate blades are complementarily sized to be slidably fixed to each other.

6. The apparatus of claim 1, wherein said plurality of first and second louver blades are interlocked to each other.

7. The apparatus of claim 6, said plurality of first louver blades have curved edges forming a recess therein, said recess for receiving edges of said plurality of second louver blades, said recesses slidably fixing said second louver blades therein.

8. The apparatus of claim 7, said upper horizontal first frame member having disposed thereon a means for a storm window frame adapter.

9. The apparatus of claim 8, said storm window frame adapter being "H" shaped having an upper recess and lower recess therein, said upper recess for receiving a lower edge of a storm window and said lower recess for mounting on said upper horizontal first frame member.

10. The apparatus of claim 9, said storm window frame adapter having a plurality of downwardly extending means for protrusions, said means for protrusions contacting said upper horizontal first frame member whereby said storm window frame adapter is secured to said upper horizontal first frame member.

11. The apparatus of claim 7, said second vertical frame member having disposed thereon a means for a storm window track adapter.

12. The apparatus of claim 11, said second vertical frame member having a first flange shaped end and a second "U" shaped end, said first flange end for insertion into a storm window track and said second "U" shaped end for receiving said second vertical frame member, said second "U" shaped end further comprising means for retaining clips whereby said second vertical frame member is secured thereto.

13. The apparatus of claim 7, further comprising means for tensioning operatively connecting said upper and lower horizontal first and second frame members, whereby said upper and lower horizontal first and second frame members are secured to each other.

14. The apparatus of claim 13, further comprising a housing having means for attachment internal said cavity of said upper and lower second frame members whereby said housing is secured in said ends of said cavity of said upper and lower second frame members.

15. The apparatus of claim 14, wherein said housing further comprises at least one tension rod means disposed thereon, said tension rod means being insertable into ends of said cavity of said upper and lower first frame member, whereby said first frame member is secured to said second frame member.

* * * * *